United States Patent [19]

Bretone

[11] 4,040,225

[45] Aug. 9, 1977

[54] BUILDING BLOCK AND WALL CONSTRUCTION

[76] Inventor: Salvatore William Bretone, 34-41 85th St., Jackson Heights, N.Y. 11372

[21] Appl. No.: 733,388

[22] Filed: Oct. 18, 1976

[51] Int. Cl.[2] ..... E04C 1/10; E04B 5/04

[52] U.S. Cl. ..... 52/585; 52/442; 52/593; 52/603; 52/605

[58] Field of Search ..... 52/442, 603, 585, 605, 52/604, 609

[56] References Cited

U.S. PATENT DOCUMENTS

| | | | |
|---|---|---|---|
| 1,809,508 | 6/1931 | Colby | 52/585 X |
| 1,816,916 | 8/1931 | Sentrop | 52/442 |
| 1,985,160 | 12/1934 | Gates | 52/604 X |
| 2,065,510 | 12/1936 | Bennett | 52/603 X |
| 2,844,022 | 7/1958 | Klem | 52/603 X |
| 3,166,873 | 1/1965 | Rosenfeld | 52/603 X |
| 3,196,582 | 7/1965 | Rosenfeld | 52/442 X |
| 3,368,317 | 2/1968 | Meigs | 52/603 X |
| 3,390,502 | 7/1968 | Carroll | 52/585 X |
| 3,545,128 | 12/1970 | La Fontaine et al. | 52/585 X |
| 3,881,571 | 5/1975 | Moulton | 52/585 X |

FOREIGN PATENT DOCUMENTS

| | | | |
|---|---|---|---|
| 466,476 | 5/1937 | United Kingdom | 52/585 |

*Primary Examiner*—Price C. Faw, Jr.
*Assistant Examiner*—Robert C. Farber
*Attorney, Agent, or Firm*—Eugene Lieberstein

[57] ABSTRACT

The building block of the present invention includes a plurality of pins which are arranged in two rows of unequal length with each projecting from a common surface in a plane perpendicular to such surface and a recessed channel on a surface opposite to such surface in alignment with the longer row and of a depth at least equal to the difference between the two rows. The recessed channel of one row of blocks serves as a guide for sliding in the adjacent upper row in forming a wall of such blocks.

9 Claims, 9 Drawing Figures

FIG. 1
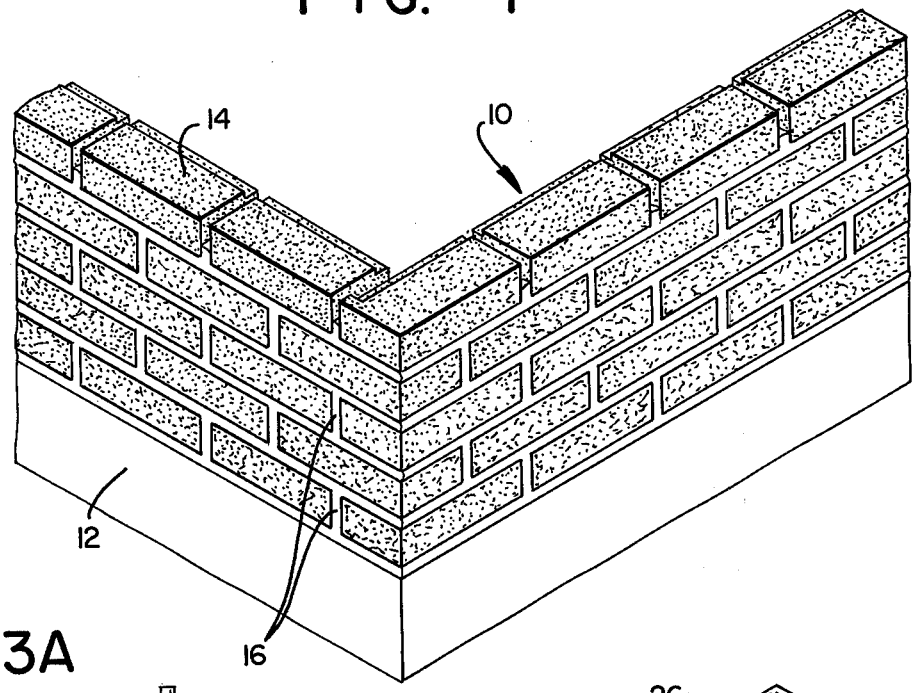
FIG. 3A
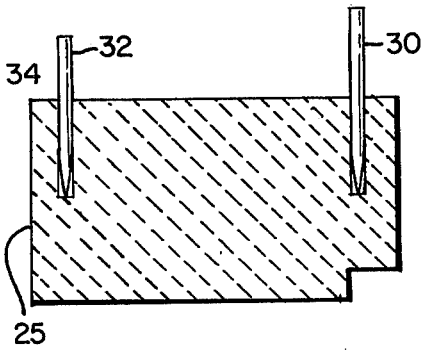
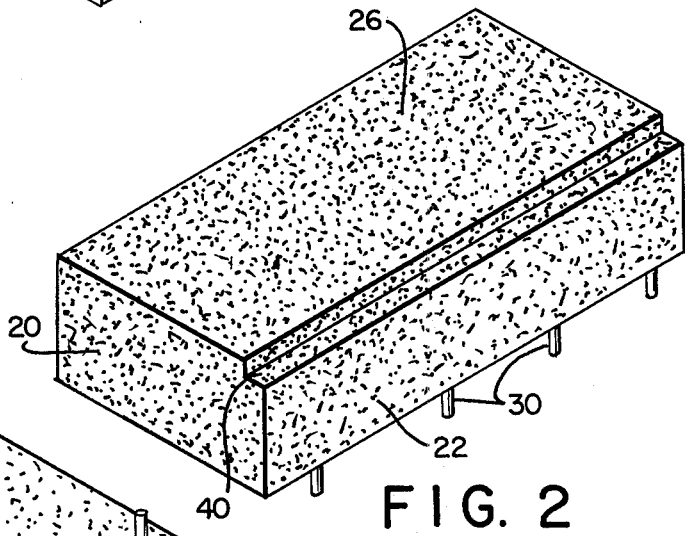
FIG. 2
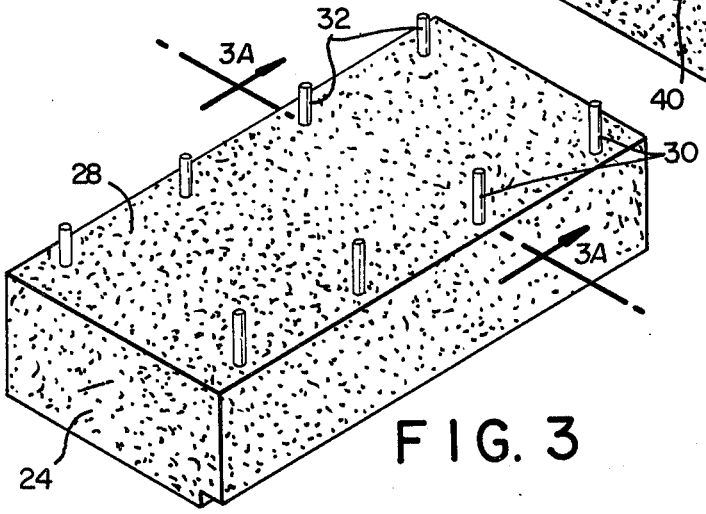
FIG. 3

FIG. 4
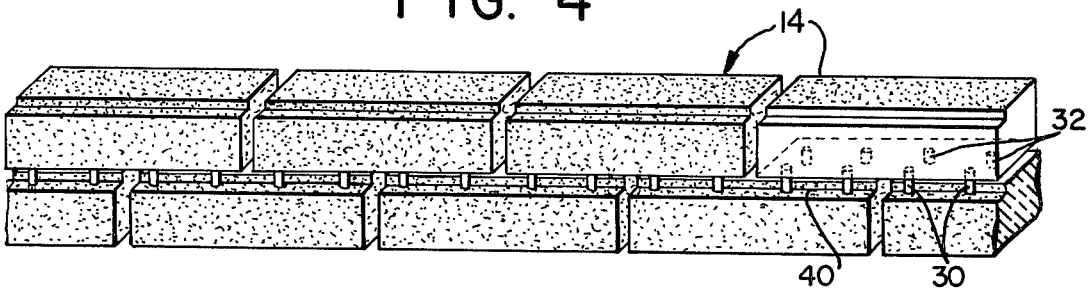
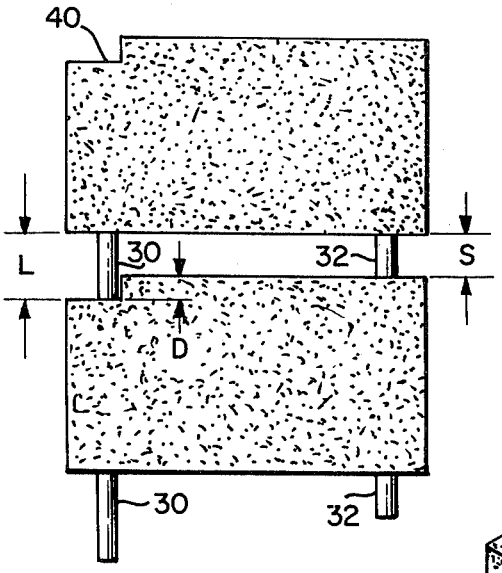
FIG. 5
FIG. 6
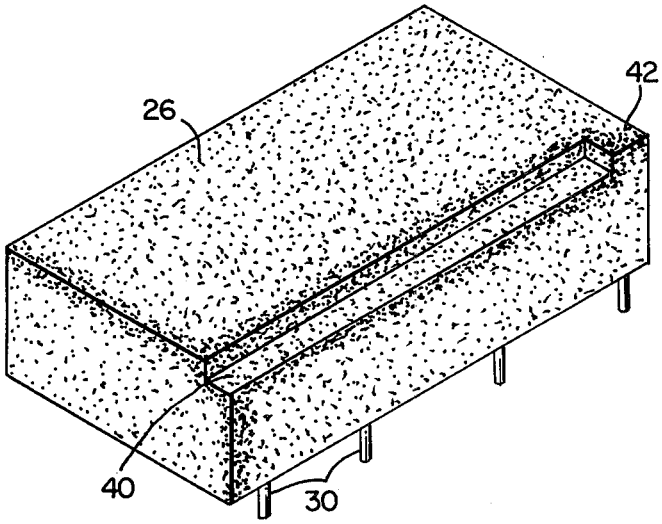
FIG. 8
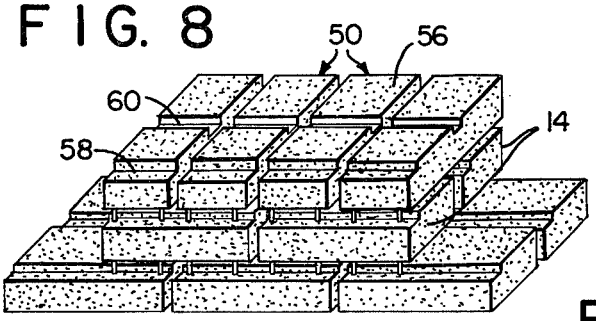
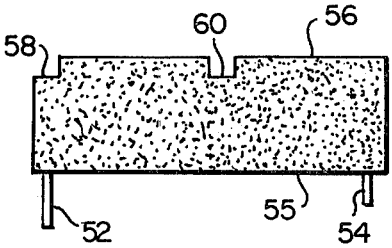
FIG. 7

BUILDING BLOCK AND WALL CONSTRUCTION

This invention relates to a novel and unique building block and to a wall construction employing such block.

The conventional method of constructing a wall composed of individual units of building block is not only highly labor intensive but requires unusual skill particularly when constructing a brick wall. The building brick used in conventional wall construction is generally molded of a clay or composition mix into a right angled solid having six plane surfaces. The bricks are laid upon a new or existing foundation in staggered rows with adjacent bricks joined together using cement mortar. To assure perfect joints, the bricklayer must square, plumb and level the bricks usually by pressing and tapping each brick one at a time. Various techniques have been proposed in the past for increasing installation speed. In general, these techniques are directed to a new method of wall construction in which the building bricks are laid dry leaving controlled interspaces which are thereafter filled with mortar in a variety of ways. In this manner the installation of brick is separated from the application of mortar. It is believed that these proposals have all been misdirected in that the difficulty in achieving faster installation speed rests with the problem of assuring a true grade and not with the incidental application of mortar to each brick. The prior art does teach the advantage of using a modified building brick configuration incorporating projections of equal size to achieve a uniform clearance between rows of brick but only to assist in the non-conventional application of mortar subsequent to the laying of the brick.

The present invention contemplates no change in the conventional method of laying bricks or in the technique for fabricating bricks and is equally applicable to a wall construction of cinder block or concrete block. According to the present invention each building block is configured in a unique way to assure a perfect joint, with level rows which are automatically plumb as well as uniformily spaced. The new and unique building block allows an inexperienced person to readily lay a true grade of brick in constructing a brick wall or a wall of cinder or concrete block.

Other advantages of the present invention will become apparent from the following detailed description thereof when read in connection with the accompanying drawings in which:

FIG. 1 is a perspective view of a part of a wall construction in accordance with the present invention;

FIG. 2 is a perspective view of a building block having the preferred configuration of the present invention for use in constructing the wall in FIG. 1;

FIG. 3 is a perspective view similar to FIG. 2 showing the reverse side of the block of FIG. 2;

FIG. 3A is a vertical section taken through the lines 3A—3A of FIG. 3;

FIG. 4 is an oblique view of part of two rows of the wall construction of FIG. 1 showing the interrelationship between the rows of block;

FIG. 5 is a side elevation of two building blocks laid upon one another for forming two rows;

FIG. 6 is a perspective view of an alternative building block configuration which may be used in conjunction with or in place of the building block of FIG. 2;

FIG. 7 is a side elevation of a row lock block in accordance with the present invention; and FIG. 8 is an oblique view of a double wall construction employing the row lock blocks of FIG. 7 for joining two rows of block together.

A portion of a partially completed wall 10 is shown in FIG. 1 constructed upon an existing or finished foundation 12. The wall 10 consists of a multiplicity of building block 14 which are laid one at a time using a conventional bonding material such as cement mortar 16 to join the blocks 14 together. For simplicity, the wall will hereinater be referred to as a brick wall and the building blocks 14 as blocks of brick. However, it should be understood that the invention is equally applicable to a wall composed of cement or cinder block. The method of laying the blocks of brick is conventional although, as will be further elaborated upon hereafter, the configurating of each brick is modified to obviate the need to level and plumb each course to assure a true grade with even spacing between rows.

Each building block 14 is composed of a conventional clay, cement or composition material which is fabricated by a conventional molding or die pressing technique into a substantially right angle solid having six plane surfaces. Four of the plane surfaces 20, 22, 24 and 25 represent the side faces shown in FIGS. 2, 3 and 3A while the other two surfaces 26 and 28 represent the major surfaces of the block with the largest surface area. The dimensions of the block 14 when representing building brick is preferably intended to conform to the standard clay molded common or finished brick which is 8 inches in length, 4 inches wide and 2 inches in thickness. The building bricks 14 are laid to form a brick wall as indicated in FIG. 1 with the major surfaces 26 and 28 aligned with their longer dimension in the horizontal direction and with each upper row staggered.

Implanted in each brick 14 is a plurality of jacks of pins 30 and 32 which project from the major surface 28 of each brick and which are arranged in a predetermined fashion to form two rows each containing an even number of pins as is more readily apparent in FIGS. 3 and 4. The pins 30 form one row of a uniform and predetermined projected length L and the pins 32 a second row of another projected length S with the projected length L of the row of pins 30 being longer than the projected length S of the row of pins 32 as is more readily apparent from FIG. 5. Each row of pins 30 and 32 is aligned parallel to the longer dimension of the brick 14 in a plane perpendicular to the plane of the major surface 28. The pins 30, 32 should be composed of a strong material preferably steel which may be case hardened so that they will not readily bend in packaging or during handling. The method of implanting the steel pins into the brick 14 is not critical although the pins in each row must be substantially uniform in projected length. It is also highly desirable that the pins be removable. Accordingly, the pins 30, 32 may either be implanted during the molding of the brick or inserted thereafter. FIG. 3A shows a preferred construction with the pins 30 inserted into the bricks 14 after they have been molded into the preferred shape which would permit the removal of all or any number of pins without suffering any damage to the brick. In such instance, the bricks 14 would be molded with a series of holes 34 in a proper orientation along the face of the major surface 28 and extending to a predetermined depth to readily accommodate the steel pins 30 and 32. The steel pins 30 and 32 could be separately or simultaneously driven or screwed into the holes 34. The imbedded end of the steel pins 30 and 32 may be tapered to make it more readily insertable and removable. A satisfactory dimension for the holes 34 when using for example, a 3/16 inch tapered steel pin, would be one-half inch in thickness by one-eigth inch wide. The pins may be withdrawn by unscrewing them, pulling them out or simply breaking them off. The reason for the removal of any number of pins, particularly the longer pins 30, will become more evident hereafter when considering the construction of corners and for a wall construction of double thickness.

A recessed channel 40 is formed on the opposite major surface 26 of each brick 14 in parallel alignment with and including the plane of the longer row of pins 30. The recessed channel 40 is of a predetermined depth D at least equal in dimension to the length L of the pins 30 minus the length S of pins 32. Accordingly, the recessed channel 40 serves as a guide for the emplacement of pins 30 when laying the next adjacent upper course of bricks 14. The shorter pins 32 will sit upon the major surface 26 to assure an even spacing between the bricks. The preferred projected length S for the pins 32 is one-half inch which is commensurate with the conventional depth of a mortar joint whereas the pins 30 should preferably project three-fourth inch in length. Hence, the depth D of the recessed channel 40 should be at least one-fourth inch to accommodate the longer pins 30.

Since the pins 30 and 32 are symmetrically distributed over the major surface 28 of the brick 14, the bricks 14 may be broken as desired to meet the dimensions of the wall being constructed without requiring special configurations. When making corners, however, the recessed channels 40 would, if it extended the entire length of the brick 14, as is shown in FIG. 2, give a slightly different appearance to the mortar joints at the exposed end which might be aesthetically undesirable. This may be prevented by not having the recessed channel 40 run the full length of the brick 14 as is shown in FIG. 6. A stop 42 may be provided at one end of the brick 14 to give the appearance of a full brick. Thus, the wall construction as shown in FIG. 1 appears conventional in all respects. The stop 42 may also serve a secondary purpose for the totally inexperienced bricklayer in that somewhat less attention would be necessary in forming joints between adjacent bricks 14 of the same row. The stop 42 is not, however, a critical feature of the present invention.

As stated earlier, it is desirable that the pins 30 and 32 be removable. If this were not the case, a number of different brick pin configurations would be necessary in constructing a wall with corners. Since the bricks between rows are staggered, the longer dimension of the major surface of one corner brick will intersect with the longer dimension of the major surface of the adjacent corner brick in the upper and lower row. Hence, at corners it will be necessary to remove two of the longer pins 30 in order to properly seat the brick 14. The two pins that are to be removed will depend on whether the corner is the left corner of the wall or the right corner since conventional construction is from right to left for a left corner and from left to right for a right corner. In the corner shown in FIG. 1, the right two rear pins would be removed in the second and fourth row. For the primary course of bricks it is preferred that the bricks be without pins. The pins can either be removed or, in accordance with the preferred construction, before inserting the pins any number of bricks can be readily set aside for use in forming the primary course.

In double row wall construction, generally above a certain height, there is a construction requirement that after laying a predetermined number of rows, the double rows be joined by orienting the next row in the transverse direction. This transverse row of bricks is commonly referred to as the row lock course. For the wall construction of the present invention the row lock course requires a separate row lock brick configuration as shown in FIG. 7. The row lock bricks 50 are arranged as shown in FIG. 8 for joining together a double row of the bricks 14. Each row lock brick 50 has six plane surfaces similar to the bricks 14 and includes a front row or two pins 52 and a parallel rear row of two pins 54 projecting from a major surface with each row aligned in a plane transverse to the longer dimension of the major surface and perpendicular to the plane of the major surface. The opposite major surface 56 has two parallel recess channels 58 and 60 respectively, each aligned to correspond with the recessed channel 40 of the adjacent lower row of bricks 14. The rear recessed channel 60 is centrally located whereas the front recessed channel 58 is aligned with the front row of pins 52. The front and rear rows of pins 52 and 54 are of unequal height when arranged so that the front row extends into a recessed channel and the rear row rests on the major surface in a manner similar to the bricks 14. Alternatively, the rear row of pins 52 may be adjacent with channel 60 in which case the front and rear row should be of the same height with each intended to project into a recessed channel 40 of the lower row of bricks 14. The front and rear recessed channels 58 and 60 permit the next adjacent upper row of bricks to be laid in the horizontal directions.

The construction of the present invention is not only compatible with conventional brick laying techniques but simplifies the conventional method to assure a true and level grade. Moreover, the resulting structure is inherently reinforced due to the projecting pins 30 and 32 and is accordingly a stronger construction than the conventional brick wall construction.

What is claimed is:

1. A wall construction composed of a multiplicity of rectangular building blocks bound together by cement mortar in an arrangement of staggered rows with each building block comprising; four minor side surfaces and two major surfaces, said two major surfaces being on opposite sides of one another with their longer dimensions disposed in a horizontal direction, a plurality of pins extending from one of said major surfaces and arranged in two equal rows each having an even number of pins with each row of pins aligned with the longer dimension in a plane perpendicular to the plane of said major surface and each row extending from said major surface, a distance unequal to the extending distance of the other row of pins, a recessed channel located along the opposite major surface in a corresponding relation with said longer extending row of pins such that the row of longer extending pins from each block extend into the recessed channel of the adjacent lower row of block for forming a reinforced structure with the channel of each row serving as a guide for the emplacement of each adjacent upper row of blocks to assure a true grade.

2. A wall construction as defined in claim 1 wherein each pin is composed of steel and is of a predetermined thickness with one end thereof being removably connected to the building block.

3. A wall construction as defined in claim 2 wherein each row of steel pins contain four pins spaced a substantially equal distance apart.

4. A wall construction as defined in claim 3 wherein said recessed channel is of a uniform depth at least equal to the difference in the extensions between said longer extension and shorter extension pins.

5. A wall construction as defined in claim 4 further comprising means for forming a stop within said recessed channel at one end of said block.

6. A wall construction as defined in claim 1, wherein said block is a building brick, said wall construction further comprising row lock means for forming a double brick, said row lock means comprising; a plurality of row lock bricks with each having two major and four side surfaces respectively and being of equal dimension to said building brick with the longer dimension of the major surfaces arranged in a direction transverse to the horizontal, a plurality of pins extending from one major surface of each row lock brick and arranged in a first and second row each having an even number of pins with each row of pins located in a plane perpendicular to the plane of said major surface and oriented parallel to its longer dimension, a first recessed channel extending along the opposite major surface of each row lock brick in a plane coinciding with the plane of said first row of pins and a second recessed channel lying parallel to the first recessed channel along such opposite major surface in a plane coinciding with the plane of said second row of pins.

7. A building block having two major surfaces and four minor surfaces for use in the construction of a wall comprising; a plurality of pins extending from one of the major surfaces and arranged in two rows each having an equal number of pins with each row of pins aligned with the longer dimension of the major surface in a plane perpendicular to the plane of said major surface and with each row extending from said major surface a distance unequal to the extending distance of the other row of pins, and a recessed channel located along the opposite major surface in a congruent relationship to said longer extending row of pins and having a depth substantially equal to the difference in extension between said longer extending and shorter extending pins.

8. A building block as defined in claim 7 wherein each pin is composed of steel and is removably connected to said building block.

9. A building block as defined in claim 8 further comprising means for forming a stop within said recessed channel at one end of said block.

* * * * *